US009204748B2

(12) United States Patent
Loomis et al.

(10) Patent No.: US 9,204,748 B2
(45) **Date of Patent: *Dec. 8, 2015**

(54) TREE TOPPER WITH TRUNK ATTACHABLE DEFORMABLE CONDUIT

(71) Applicant: Loominocity, Inc., Napa, CA (US)

(72) Inventors: Jason Loomis, Decatur, GA (US); Alexander B. Loomis, New York, NY (US); Ryan Seyffert, Bellingham, MA (US)

(73) Assignee: Loominocity, Inc., Napa, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/327,367

(22) Filed: Jul. 9, 2014

(65) Prior Publication Data

US 2014/0321130 A1 Oct. 30, 2014

Related U.S. Application Data

(63) Continuation-in-part of application No. 12/231,342, filed on Sep. 2, 2008, now Pat. No. 8,801,227, and a continuation-in-part of application No. 13/767,833, filed on Feb. 14, 2013, now Pat. No. 8,807,798, which (Continued)

(51) Int. Cl.
*F21S 4/00* (2006.01)
*F21V 21/00* (2006.01)
(Continued)

(52) U.S. Cl.
CPC ..... *A47G 33/08* (2013.01); *A47G 33/10* (2013.01); *F21V 21/088* (2013.01); *F21V 21/32* (2013.01); *A47G 2033/0827* (2013.01); *F21W 2121/04* (2013.01); *F21Y 2101/02* (2013.01)

(58) Field of Classification Search
CPC ..... A47G 33/08; A47G 33/10; F21V 21/088; F21V 21/32
USPC ..... 362/249.01–249.06, 249.19, 396, 362/565–568, 653–654, 806–807
See application file for complete search history.

(56) References Cited

U.S. PATENT DOCUMENTS 3,970,834 A 7/1976 Smith
4,099,824 A 7/1978 Schoppelrey
(Continued)

FOREIGN PATENT DOCUMENTS

EP 2234223 9/2010
WO WO2008131524 11/2008

OTHER PUBLICATIONS

International Search Report from PCT Application, PCT/US/2012/030120, dated Jun. 27, 2012.
(Continued)

*Primary Examiner* — Jason Moon Han
(74) *Attorney, Agent, or Firm* — Craige Thompson; Thompson Patent Law

(57) ABSTRACT

Apparatus and associated methods relate to a tree-top ornament apparatus configured to present a removeably attachable ornament above a top of a tree and supporting the presented ornament by clamping an ornament-connected deformable conduit to a secure portion of a tree trunk below the top of the tree. In an illustrative embodiment, the conduit may be deformable and yet semi-rigid so as not to deform under the weight of the presented ornament. In some embodiments, a sleeve may be configured to provide an electrical signal to a light emitting device for illuminating the ornament. The sleeve may include a light emitting device within a top hollow of the sleeve. In some embodiments, the light emitting device may be configured to illuminate a clear or semi-clear ornament received in the top hollow of the sleeve. The tree-top ornament apparatus may advantageously secure a tree-top ornament to the tree trunk at a location where the trunk is strong.

20 Claims, 13 Drawing Sheets

Related U.S. Application Data is a continuation of application No. 12/986,066, filed on Jan. 6, 2011, now Pat. No. 8,398,269, application No. 14/327,367, which is a continuation-in-part of application No. 13/745,795, filed on Jan. 19, 2013, which is a continuation-in-part of application No. 13/288,114, filed on Nov. 3, 2011, now abandoned, which is a continuation-in-part of application No. 12/836,425, filed on Jul. 14, 2010, now Pat. No. 8,053,042, application No. 14/327,367, which is a continuation-in-part of application No. 13/426,577, filed on Mar. 21, 2012.

(60) Provisional application No. 60/967,026, filed on Sep. 1, 2007, provisional application No. 61/292,737, filed on Jan. 6, 2010, provisional application No. 61/225,258, filed on Jul. 14, 2009, provisional application No. 61/466,402, filed on Mar. 22, 2011.

(51) Int. Cl.

| | |
|---|---|
| ***A47G 33/08*** | (2006.01) |
| ***A47G 33/10*** | (2006.01) |
| ***F21V 21/088*** | (2006.01) |
| ***F21V 21/32*** | (2006.01) |
| *F21W 121/04* | (2006.01) |
| *F21Y 101/02* | (2006.01) |

(56) References Cited

U.S. PATENT DOCUMENTS

| | | | |
|---|---|---|---|
| 4,125,781 | A | 11/1978 | Davis, Jr. |
| 4,417,299 | A | 11/1983 | Rupp |
| 4,571,018 | A | 2/1986 | Anoot |
| 4,855,880 | A | 8/1989 | Mancusi, Jr. |
| 5,034,547 | A | 7/1991 | Smith et al. |
| 5,035,630 | A | 7/1991 | Norsworthy |
| 5,094,632 | A | 3/1992 | Chen et al. |
| 5,237,491 | A | 8/1993 | McCarter |
| 5,245,519 | A | 9/1993 | Openiano |
| 5,372,525 | A | 12/1994 | Wu et al. |
| 5,409,745 | A | 4/1995 | McGuire |
| 5,422,797 | A | 6/1995 | Shattan |
| 5,554,049 | A | 9/1996 | Reynolds |
| 5,565,728 | A | 10/1996 | Jung |
| 5,639,157 | A | 6/1997 | Yeh |
| 5,652,032 | A | 7/1997 | Kaczor et al. |
| 5,747,940 | A | 5/1998 | Openiano |
| 5,776,559 | A | 7/1998 | Woolford |
| 5,834,901 | A | 11/1998 | Shen |
| 5,911,600 | A | 6/1999 | Mosquera |
| 6,072,280 | A | 6/2000 | Allen |
| 6,135,283 | A | 10/2000 | Huang |
| 6,340,233 | B1 | 1/2002 | Shieh |
| 6,341,874 | B1 | 1/2002 | Rubin |
| 6,422,891 | B1 | 7/2002 | Huang |
| 6,457,839 | B1 | 10/2002 | Grandoit |
| 6,458,435 | B1 | 10/2002 | Lai |
| 6,588,914 | B1 | 7/2003 | Tang |
| 6,653,797 | B2 | 11/2003 | Puleo et al. |
| 6,773,134 | B2 | 8/2004 | Harvey |
| 6,840,663 | B2 | 1/2005 | Kao |
| 7,052,156 | B2 | 5/2006 | Primeau |
| 7,118,249 | B2 | 10/2006 | Hsu et al. |
| 7,144,610 | B1 | 12/2006 | Estes et al. |
| 7,222,987 | B2 | 5/2007 | Tseng |
| 7,344,275 | B2 | 3/2008 | Allen et al. |
| 7,520,633 | B2 | 4/2009 | Hornsby et al. |
| 7,585,552 | B2 | 9/2009 | Meseke |
| 7,854,532 | B2 | 12/2010 | Myers et al. |
| 8,002,456 | B2 | 8/2011 | Chien |
| 8,128,259 | B2 | 3/2012 | Myers et al. |
| 2002/0168894 | A1 | 11/2002 | Goebel |
| 2003/0156411 | A1 | 8/2003 | Ahroni |
| 2004/0075401 | A1 | 4/2004 | Segan et al. |
| 2004/0233668 | A1 | 11/2004 | Telfer et al. |
| 2005/0104533 | A1 | 5/2005 | Barthelmess |
| 2005/0122718 | A1 | 6/2005 | Kazar et al. |
| 2006/0164834 | A1 | 7/2006 | Kao |
| 2006/0256556 | A1 | 11/2006 | Huang |
| 2006/0258222 | A1 | 11/2006 | Tseng |
| 2006/0262529 | A1 | 11/2006 | Hornsby et al. |
| 2006/0291217 | A1 | 12/2006 | Vanderschuit |
| 2007/0195527 | A1 | 8/2007 | Russell |
| 2007/0230174 | A1 | 10/2007 | Hicks et al. |
| 2009/0085487 | A1 | 4/2009 | Braasch |
| 2009/0128046 | A1 | 5/2009 | Tsai |
| 2010/0090607 | A1 | 4/2010 | Vos |
| 2010/0118532 | A1 | 5/2010 | Liang et al. |
| 2010/0327767 | A1 | 12/2010 | Fay |
| 2011/0051471 | A1 | 3/2011 | Chen et al. |

OTHER PUBLICATIONS

Environmentallights, 3-Channel LED Chasing Christmas Crab Lights (Warm White), YouTube, http://www.youtube.com/watch?v=BV1UvjJB4HA, Sep. 8, 2011.

TREE TOPPER WITH TRUNK ATTACHABLE DEFORMABLE CONDUIT

CROSS-REFERENCE TO RELATED APPLICATIONS

This instant application claims the benefit and is a continuation-in-part of U.S. patent application Ser. No. 12/231,342, titled "Illuminated Tree Top Ornament Apparatus," filed by Jason A. Loomis on Sep. 2, 2008, which claims the benefit of U.S. Provisional Application Ser. No. 60/967,026, titled "Illuminated Tree Top Ornament Apparatus," filed by Jason A. Loomis on Sep. 1, 2007.

The instant application also claims the benefit and is a continuation-in-part of U.S. patent application Ser. No. 13/745,795, titled "Architecture for Routing Multi-Channel Commands via a Tree Column," filed by Jason Loomis on Jan. 19, 2013, which claims the benefit and is a continuation-in-part of U.S. patent application Ser. No. 13/288,114, titled "Artificial Tree Apparatus with Axial Electrical Connectors," filed by Jason Loomis on Nov. 3, 2011, now abandoned, which claims the benefit and is a continuation-in-part of U.S. patent application Ser. No. 12/836,425, titled "Artificial Tree Apparatus," filed by Jason Loomis on Jul. 14, 2010, now U.S. Pat. No. 8,053,042, which claims the benefit of U.S. Provisional Application Ser. No. 61/225,258, titled "Artificial Tree Apparatus," filed by Jason A. Loomis on Jul. 14, 2009.

The instant application also claims the benefit and is a continuation-in-part of U.S. patent application Ser. No. 13/767,833, titled "Decorative Holographic Ornament," filed by Jason Loomis on Feb. 14, 2013, which claims the benefit and is a continuation of U.S. patent application Ser. No. 12/986,066, titled "Decorative Holographic Ornament," filed by Jason Loomis on Jan. 6, 2011, which claims the benefit of U.S. Provisional Application Ser. No. 61/292,737, titled "Decorative Holographic Sphere," filed by Jason Loomis on Jan. 6, 2010.

The instant application also claims the benefit and is a continuation-in-part of U.S. patent application Ser. No. 13/426,577, titled "Low Voltage Coupling Design," filed by Jiangmen Yi Xin Long on Mar. 21, 2012, which claims the benefit of U.S. Provisional Application Ser. No. 61/466,402, titled "Low Voltage Coupling Design," filed by Jiangmen Yi Xin Long on Mar. 22, 2011.

This application fully incorporates the disclosures of the following previously submitted applications by reference herein:

| Ser. No. | Title | Filing Date |
|---|---|---|
| 12/231,342 | Illuminated Tree Top Ornament Apparatus | Sep. 2, 2008 |
| 60/967,026 | Illuminated Tree Top Ornament Apparatus | Sep. 1, 2007 |
| 13/745,795 | Architecture for Routing Multi-Channel Commands via a Tree Column | Jan. 19, 2013 |
| 13/288,114 | Artificial Tree Apparatus with Axial Electrical Connectors | Nov. 3, 2011 |
| 12/836,425 | Artificial Tree Apparatus | Jul. 14, 2010 |
| 61/225,258 | Artificial Tree Apparatus | Jul. 14, 2009 |
| 13/767,833 | Decorative Holographic Ornament | Feb. 14, 2013 |
| 12/986,066 | Decorative Holographic Ornament | Jan. 6, 2011 |
| 61/292,737 | Decorative Holographic Sphere | Jan. 6, 2010 |
| 13/426,577 | Low Voltage Coupling Design | Mar. 21, 2012 |
| 61/466,402 | Low Voltage Coupling Design | Mar. 22, 2011 |

TECHNICAL FIELD

Various embodiments relate generally to remote control of holiday lights.

BACKGROUND

Holiday light displays are popular in today's culture. Many families set up elaborate holiday light displays. People tour the city in search of the best and most beautiful light displays. Neighbors may enjoy the competition of providing interesting and different holiday light displays. These displays may include crib scenes, decorated trees, stars, angels, Santa, and other display elements. Some lighting displays are multi colored and some are single colored. Some light displays are exterior to a home or a place of business. Such light displays may include environmentally tolerant lighting elements. Some light displays are interior displays. Some interior lighting displays include an artificial holiday tree.

SUMMARY

Apparatus and associated methods relate to a tree-top ornament apparatus configured to present a removeably attachable ornament above a top of a tree and supporting the presented ornament by clamping a ornament-connected deformable conduit to a secure portion of a tree trunk below the top of the tree. In an illustrative embodiment, the conduit may be deformable and yet semi-rigid so as not to deform under the weight of the presented ornament. In some embodiments, a sleeve may be configured to provide an electrical signal to a light emitting device for illuminating the ornament. The sleeve may include a light emitting device within a top hollow of the sleeve. In some embodiments, the light emitting device may be configured to illuminate a clear or semi-clear ornament received in the top hollow of the sleeve. The tree-top ornament apparatus may advantageously secure a tree-top ornament to the tree trunk at a location where the trunk is strong.

Apparatus and associated methods may relate to a tree embedded electrical signal distribution network for providing power and control signals to lighting elements associated with multiple independent control channels. In an illustrative embodiment, trunk segments of an artificial tree may have multiple control channels coupled therein. In some embodiments, mechanical connection of trunk segments may electrically connect corresponding control channels. In an exemplary embodiment, mechanical connection of a branch to a trunk segment may electrically connect a control channel coupled to the branch to one of the control channels of the trunk segment. In some embodiments, a switch associated with a branch connection may provide user selected association of one of the control channels coupled to the trunk segment to a control channel coupled to a branch coupled thereto. Some exemplary tree embedded electrical signal distribution networks may automatically be constructed by mechanically constructing an artificial tree.

Various embodiments may achieve one or more advantages. For example, some embodiments may provide a user lighting control of a holiday display from the comfort of a couch. In some embodiments, a lighting display may be remotely configured while one is away from home, for example.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

Figure 1:
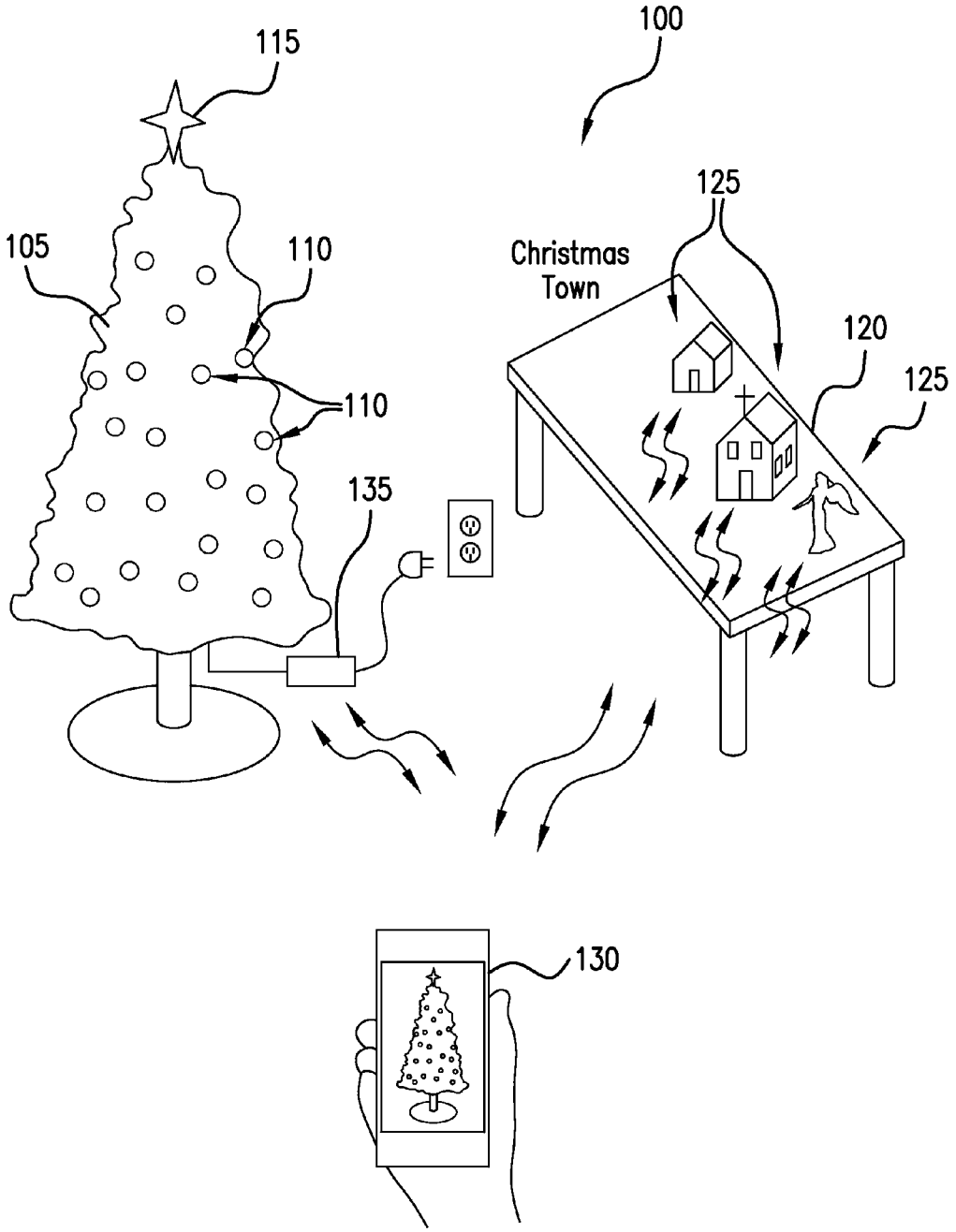
FIG. 1 depicts an exemplary remotely controlled Christmas display illumination system.

FIG. 1 depicts an exemplary remotely controlled holiday display system. In FIG. 1, a room 100 has been decorated for a celebration of a holiday. A holiday tree 105 has been set up and decorated with tree lights 110 and a tree-top ornament 115. A table 120 has been decorated with Christmas town figures 125. Each of the Christmas town figures 125 may have light elements and/or other controllable features that may be remotely controlled and/or configured. A mobile device 130 is depicted as running an app configured to provide remote control and/or remote configuration of the tree lights 110 and/or the tree-top ornament 115. The app may also be configured to control and or configure the various town figures 125. The tree lights 110 may be locally controlled by a control module 135. Communication between the control module 135 and the mobile device 130 may be performed wirelessly. The control module, may then send control signals to one or more individual tree lights 110 via a distribution network coupled to the holiday tree 105. The tree lights 110 may illuminate in a way corresponding the control signal. For example, a light unit may illuminate as a particular hue. In some embodiments, the intensity of illumination change as a function of time (e.g. blink or increase in intensity). Some embodiments may advantageously provide remote control and/or configuration of holiday lighting displays.

In some embodiments, an app may send a signal to devices within range of the mobile device 130 the signal corresponding to request for remotely controllable devices to identify themselves. The app may then receive an identification signals from the responsive remotely controllable devices and then may make a list of identified remotely controllable devices. The app may then display the list of remotely controllable devices to a user. The app may then receive an input from the user, the input selecting one or more device for control. The app may present to the user a list of controllable modes and/or functions associated with the user selected device. The app may then receive the user's selection and/or input associated with a display mode and/or function. The app may then wirelessly transmit a control signals to a control module 135 associated with the selected device. The control module 135 may then send electrical signals corresponding to the display mode and/or function to the selected device or devices. The signals may be sent to individual light units and/or groups of light units and/or other control modules via the distribution network coupled to the holiday tree 105. The signals may be send via the distribution network coupled to the holiday tree 105. The distribution network may include one or more electrical channels. For example, an artificial tree may have one or more electrical channel coupled to one or more trunk sections. In some embodiments, tree limbs may have one or more electrical channels. Electrical conductivity between a tree limb and a trunk section may be completed concurrently with mechanically coupling a tree limb to a channel section, for example.

The tree topper 115 depicted in FIG. 1 may be coupled to a top vertical branch of the tree 105 via a connection below a top of the top vertical branch. The top of the top vertical branch may be insufficient in strength to securely support a tree top ornament. The top vertical branch may be stronger at a location below the top of the top vertical branch. The tree topper 115 may have one or more light elements. The one or more light elements of the tree topper 115 may be electrically coupled to the one or more electrical channels in the tree 105.

In various embodiments, a power and signal distribution network may be embedded within an artificial tree. Various exemplary power and signal distribution networks have been described, for example, at [0044] and in FIG. 5 of U.S. patent application Ser. No. 13/288,114, titled "Artificial Tree Apparatus with Axial Electrical Connectors," filed by Jason Loomis on Nov. 3, 2011, the entire disclosure of which is hereby incorporated by reference. For example, in FIG. 1 of the '114 application, a multi segment tree trunk is depicted. In some embodiments, each of the tree trunk segments may have one or more electrical channels. When the tree trunk segments are mechanically connected to one another, an electrical coupler in each trunk may make electrical connection between corresponding electrical channels. In an illustrative example, two adjacent tree trunk segments may each have four electrical channels. When the adjacent tree trunk segments are mechanically connected, a first channel of a first tree trunk segment may be electrically coupled to a first channel of a second tree trunk segment. Also, corresponding second channels of the adjacent tree trunks may be electrically coupled in the same manner. A third and a fourth channel, respectively may be coupled as the first and second channels above.

In some embodiments, branches of artificial trees may each have one or more electrical channels coupled thereto. Various embodiments of connecting electrical channels in branches to electrical channels in tree trunks have been described, for example, at [0038-0042] and in FIGS. 3-4 of U.S. patent application Ser. No. 13/745,795, titled "Architecture for Routing Multi-Channel Commands via a Tree Column," filed by Jason Loomis on Jan. 19, 2013, the entire disclosure of which is hereby incorporated by reference. In the embodiment depicted in FIGS. 3-4 of the '795 application, branch/trunk connections are shown. In some embodiments a branch may have a single electrical channel. Such a single channel branch may couple to one of the channels in a trunk segment when the branch is mechanically connected to the trunk segment. In some embodiments, a branch may have two or more electrical channels. Such multi-channel branches may couple one or more of the channels in the branch to one or more channels in the trunk segment to which the branch is mechanically connected.

In some embodiments, signal and power distribution networks are established simultaneous with the mechanical construction of an artificial tree. In some embodiments, the signal and power distribution network is fixed, wherein a branches electrical channel configuration is fixed by its mechanical location. In some embodiments, the signal and power distribution network of a branch may be configured independently of the branches mechanical position. For example, in some embodiments, a selection switch associated with a branch may select one or more electrical channels for branch connection from a plurality of trunk channels. In some embodiments, the branch channel configuration may be performed using an electrical signal, for example. In some embodiments, each light element may independently be assigned or associated with a channel. In an exemplary embodiment each light element may be independently addressable.

Various control modes and/or control functions may be performed. For example, in some embodiments, a wave of color be displayed at the top of a tree. The color may then slowly begin being displayed to lower regions of the tree, until the wave of color is displayed by the lighting elements located at the bottom of the tree. Such a coordinated display may be done by a controller sending a time sequenced series of commands to individual light element controllers. In some embodiments, each light element may have a controller coupled thereto. For example, each light element/controller may be coupled to a common control bus. Each light element may, for example, be a slave on the bus, listening for an address corresponding to the light element. When a light element detects that light elements address, a command associated with the transmission containing the address may be received by that light element. The received transmission may include a lighting command for that particular light element. The light element may then perform the commanded function. For example, a light element may change its illumination color in response to receiving a color-change command. In an exemplary embodiment, a light element may change its light intensity in response to an intensity-change command. In some embodiments a turn-on or turn-off command may be received by a light element.

In some embodiments, the electrical distribution network may include power or may even only be a power distribution network. In some embodiments, each lighting element may include a wireless receiver for receiving control transmissions, for example. In an exemplary embodiment, a single pair of conductors may carry both power and control signals. For example a power and signal distribution network may include a positive power line and a negative power line. A control signal may modulate the voltage difference between the positive power line and the negative power line, for example. Exemplary lighting control modules may decode control signal modulation of the power line. The control module than may send local signals to lighting elements in response to the decoded control signals.

Figure 2:
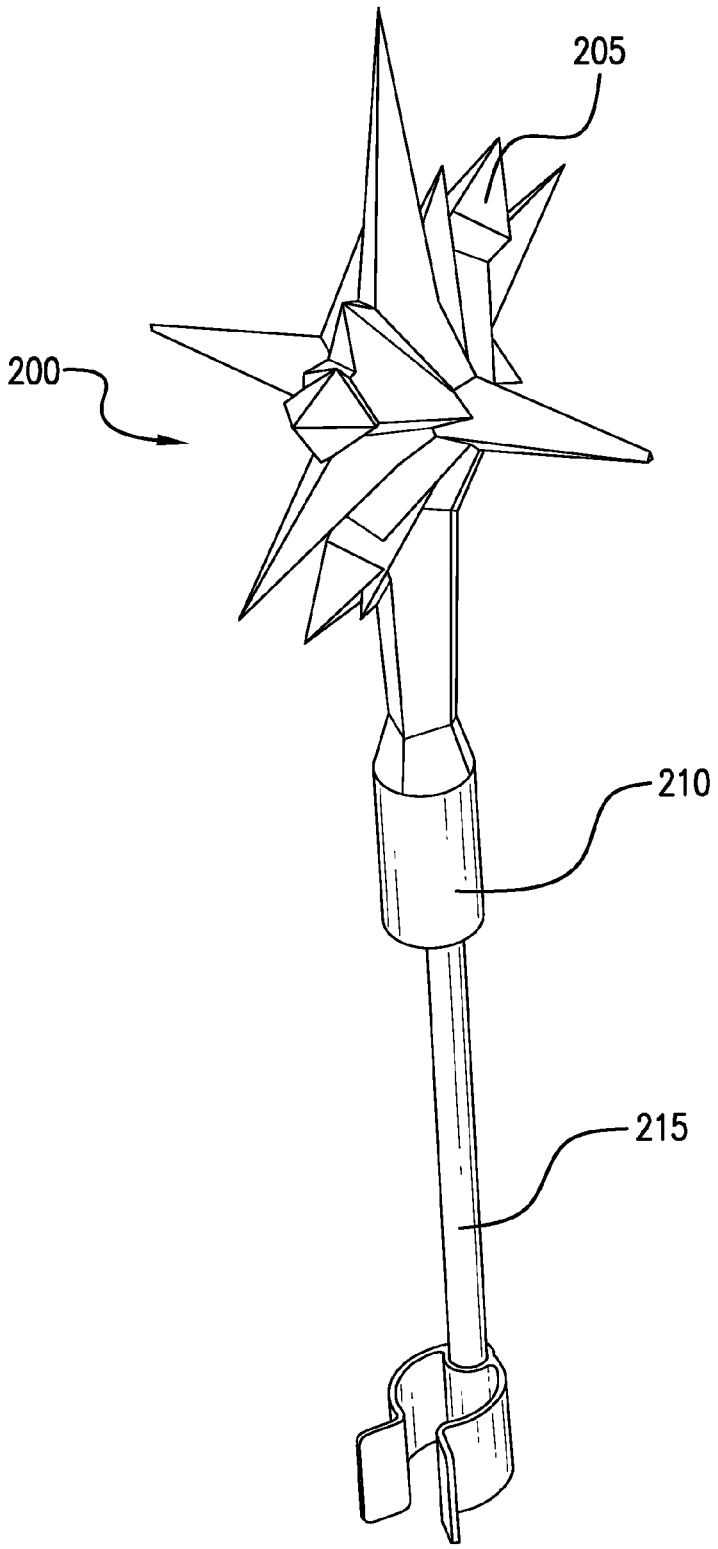
FIG. 2 depicts a perspective view of an exemplary tree topper with trunk attachable deformable conduit.

FIG. 2 depicts a perspective view of an exemplary tree topper with trunk attachable deformable conduit. In FIG. 2, an exemplary tree topper device 200 includes an ornament 205 coupled to a sleeve 210. The sleeve 210 is supported by a deformable conduit 215. The deformable conduit 215 is configured to couple to a tree trunk at a location beneath the top of the tree trunk. The top of the tree trunk may be flexible and incapable of supporting the tree topper device 200. But at a distance beneath the top of the tree trunk, the trunk may be less flexible and may be more capable of supporting the tree topper device 200. For example, the very top of the trunk of a real tree may be a new growth branch. The new growth branch may be relatively thin and flexible. But a short distance below the new growth may be the trunk portion associated with last year's growth. This portion may be less flexible and thicker than the top new growth portion. Again a short distance below this last year's growth portion may be two-year's ago growth portion of the tree trunk. This two-year's ago growth portion may be yet stronger and thicker than even last year's growth portion. Coupling a tree topper device to one of portions of the tree trunk that is below the top portion may provide the strength and/or inflexibility needed to secure the tree topper device to the tree.

In an artificial tree the top branch may be relatively week in comparison to the tree trunk to which it is connected. Connecting a tree topper device to the tree trunk may provide a more rigid connection than connecting the tree topper device to the top branch. The trunk connected tree topper device may advantageously reduce the danger of accidental falling of the tree topper device, for example. Connecting the tree topper device to a tree trunk may permit quick alignment of the tree topper device to the top branch.

Figure 3:
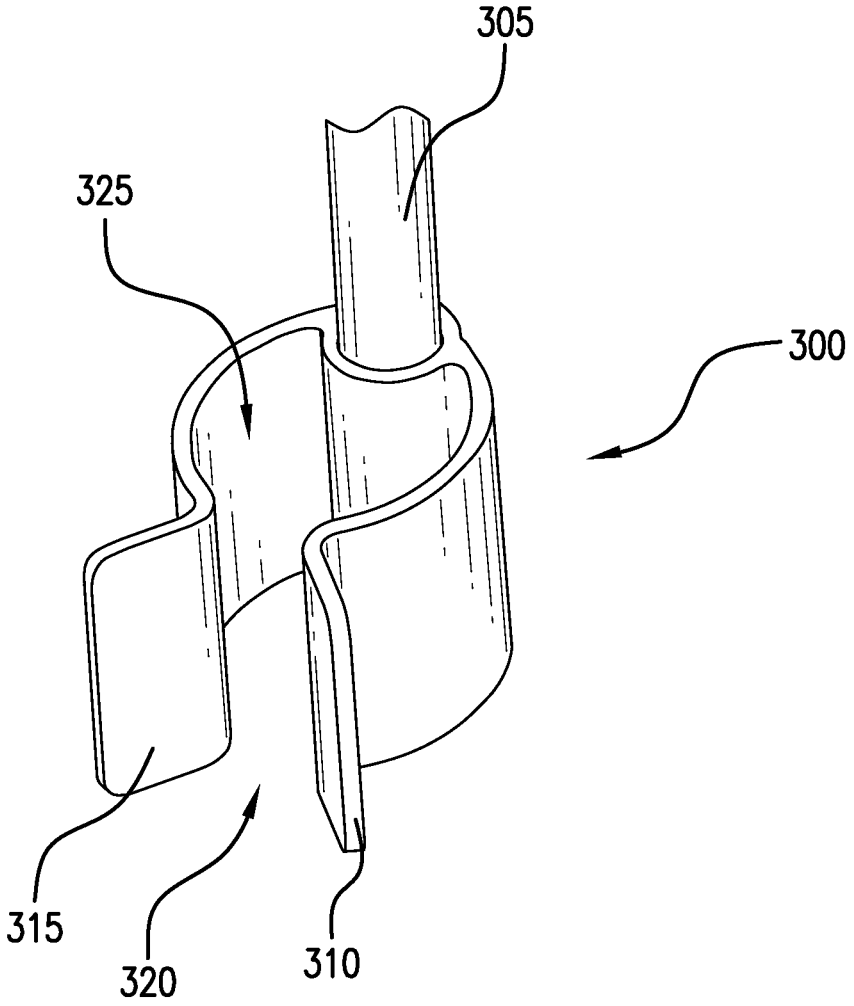
FIG. 3 depicts a close-up perspective view of an exemplary clip-style clamp for a tree topper with trunk attachable deformable conduit.

FIG. 3 depicts a close-up perspective view of an exemplary clip-style clamp for a tree topper with trunk attachable deformable conduit. In FIG. 3, a clip-style clamp 300 is coupled to a deformable conduit 305. The clip-style clamp may include two flexible lips 310, 315. The flexible lips 310, 315 may be opposed to one another. A tree trunk may be inserted into a vertical opening 320 between the two opposed flexible lips 310, 315. The two opposed flexible lips 310, 315 may deformable open to permit a trunk larger than the vertical opening to be received into a trunk reception cavity 325.

Figure 4:
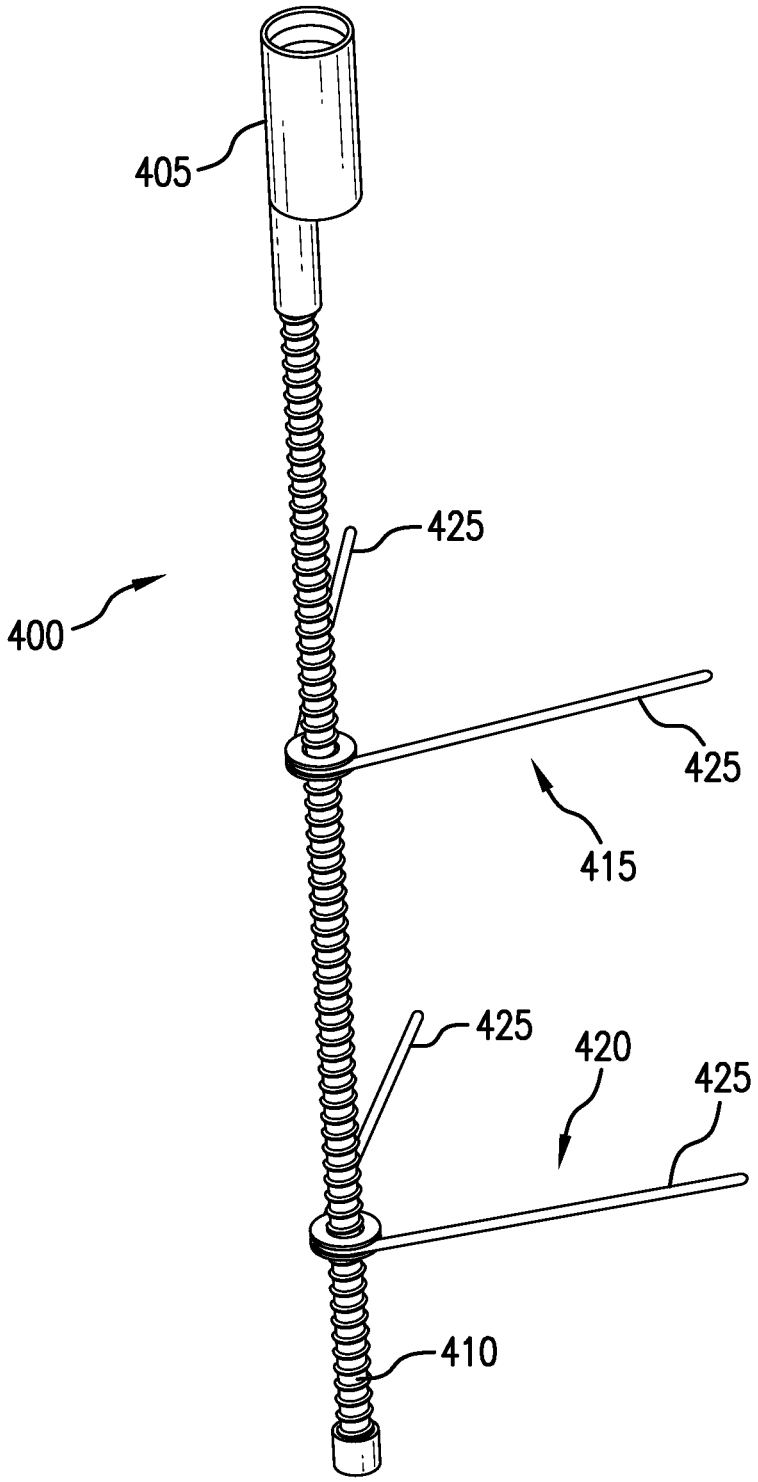
FIG. 4 depicts a perspective view of an exemplary tree topper with trunk attachable deformable conduit.

FIG. 4 depicts a perspective view of an exemplary tree topper with trunk attachable deformable conduit. In FIG. 4 an exemplary tree topper 400 includes an ornament sleeve 405 and a deformable conduit 410. Two twist-tie type of connectors 415, 420 are coupled to the deformable conduit 410. The deformable conduit 410 may a threaded exterior surface for example. Each of the twist-tie connectors 415, 420 may be spun on the threads to vertically locate each twist-tie connector 415, 420 at a desired position along the deformable conduit 410. Each of the twist-tie connectors is shown having two deformable arms 425 that can be wrapped around a tree trunk. After securing the tree topper 400 to the tree, the conduit may be deformed so as to align the ornament to the tree trunk, for example. A user may desire to axially align the ornament with the tree trunk for example. The conduit may be slightly offset axially from the tree trunk, and so an S-curve deformation may bring the ornament in axial alignment with the tree trunk.

Figure 5:
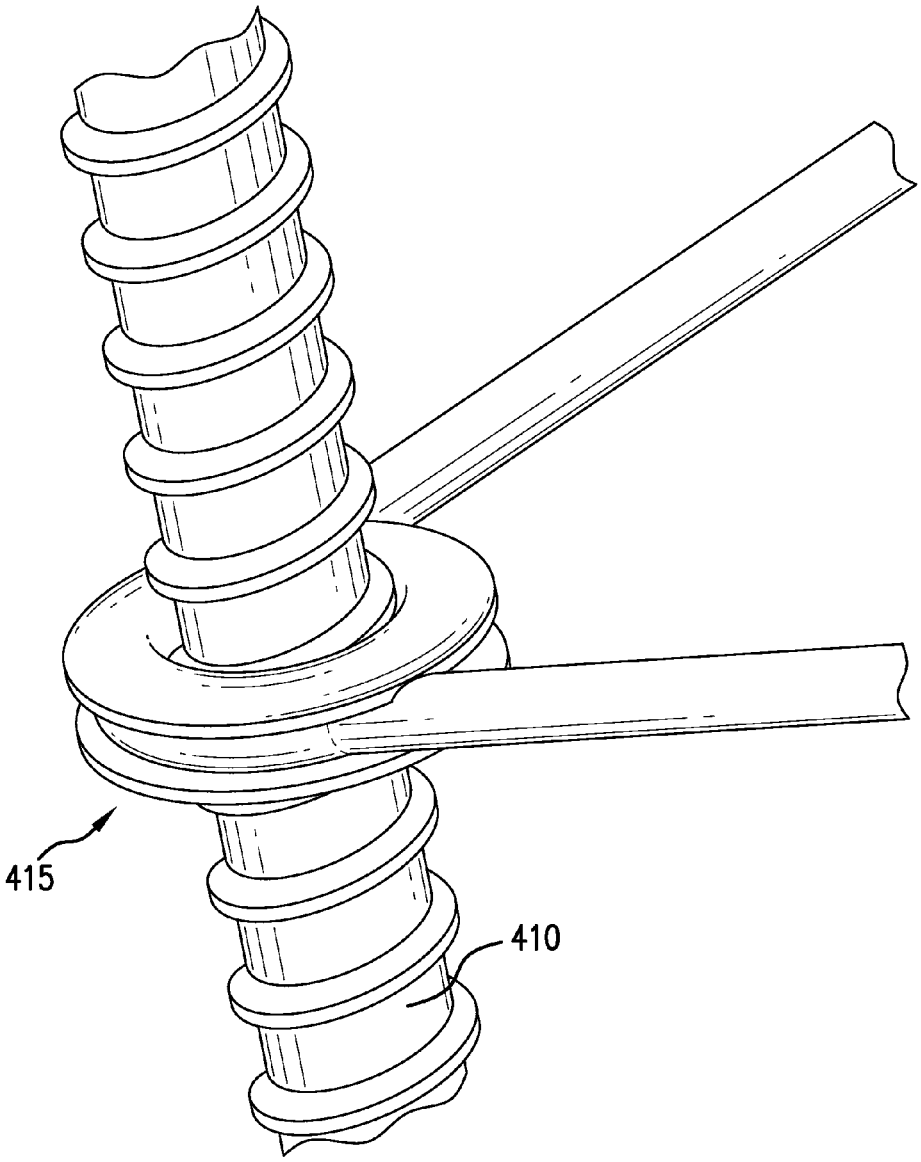
FIG. 5 depicts a close-up perspective view of an exemplary twist-tie clamp for a tree topper with trunk attachable deformable conduit.

FIG. 5 depicts a close-up perspective view of an exemplary twist-tie clamp for a tree topper with trunk attachable deformable conduit. In the FIG. 5 depiction the exterior surface of the deformable conduit 410 depicts the exterior thread described above. The twist-tie connector 415 may have threading corresponding to the exterior threading of the deformable conduit 410, for example.

Figure 6:
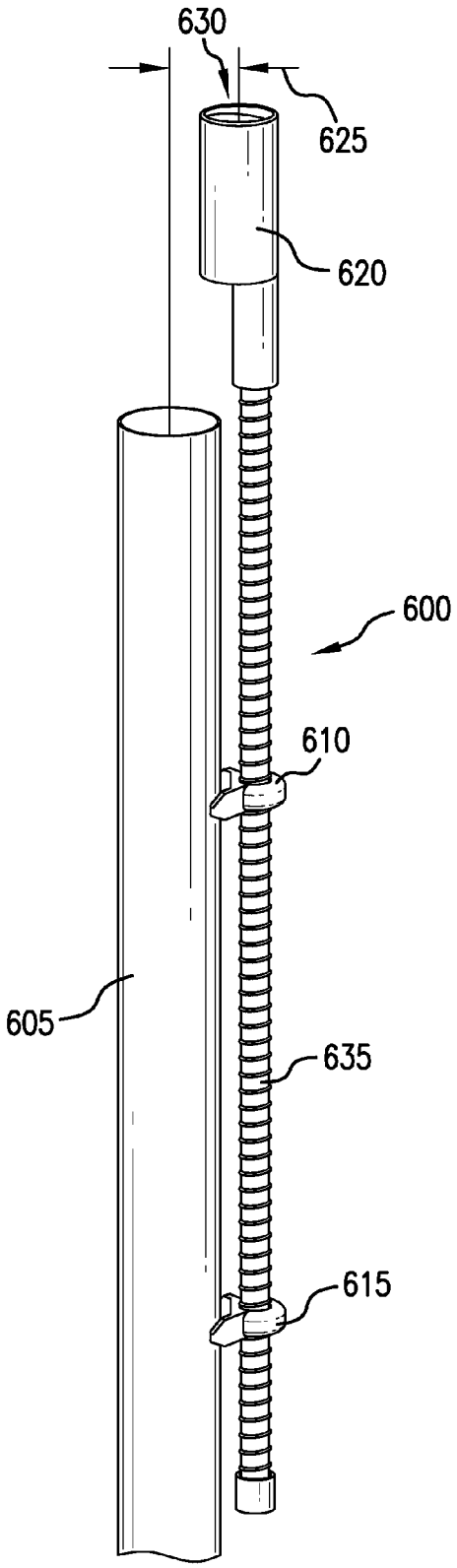
FIG. 6 depicts a perspective view of an exemplary tree topper with trunk attachable deformable conduit magnetically attached to an artificial tree trunk.

FIG. 6 depicts a perspective view of an exemplary tree topper with trunk attachable deformable conduit magnetically attached to an artificial tree trunk. In FIG. 6, a tree topper device 600 is shown attached to an artificial tree trunk 605. The artificial tree trunk 605 is depicted as a hollow tube. The artificial tree trunk 605 may contain magnetic material so as to be couple able to a magnet. The depicted tree topper 600 has two magnetic connectors 610, 615. Each of the magnetic connectors has alignment arms that have a coupling surface that tangentially receives a cylindrical trunk. An ornament sleeve 620 is presented at a vertical position above a top of the tree trunk 605. An axial separation distance 625 between the tree trunk 605 and an ornament receiving hollow 630 is depicted. S-shaped deformation of a deformable conduit 635 may bring the ornament receiving hollow into axial alignment with the tree trunk 605.

Figure 7:
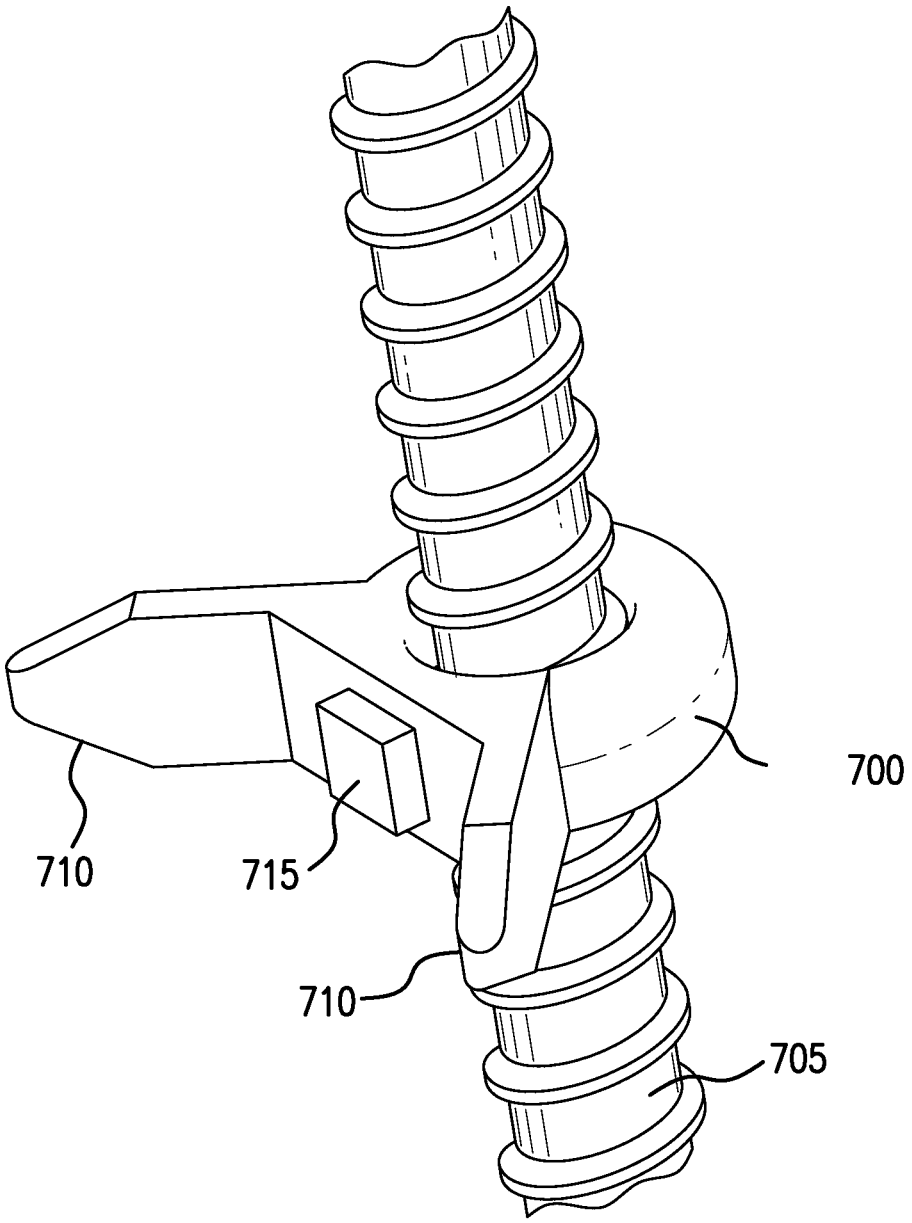
FIG. 7 depicts a close-up perspective view of an exemplary magnetic clamp for a tree topper system.

FIG. 7 depicts a close-up perspective view of an exemplary magnetic clamp for a tree topper system. In FIG. 7, an exemplary magnetic coupler 700 is shown attached to a deformable conduit 705. The magnetic coupler 700 includes two trunk receiving arms 710 and a magnet 715. The magnet 715 presents a tangential face to a received cylindrical tree trunk.

Figure 8:
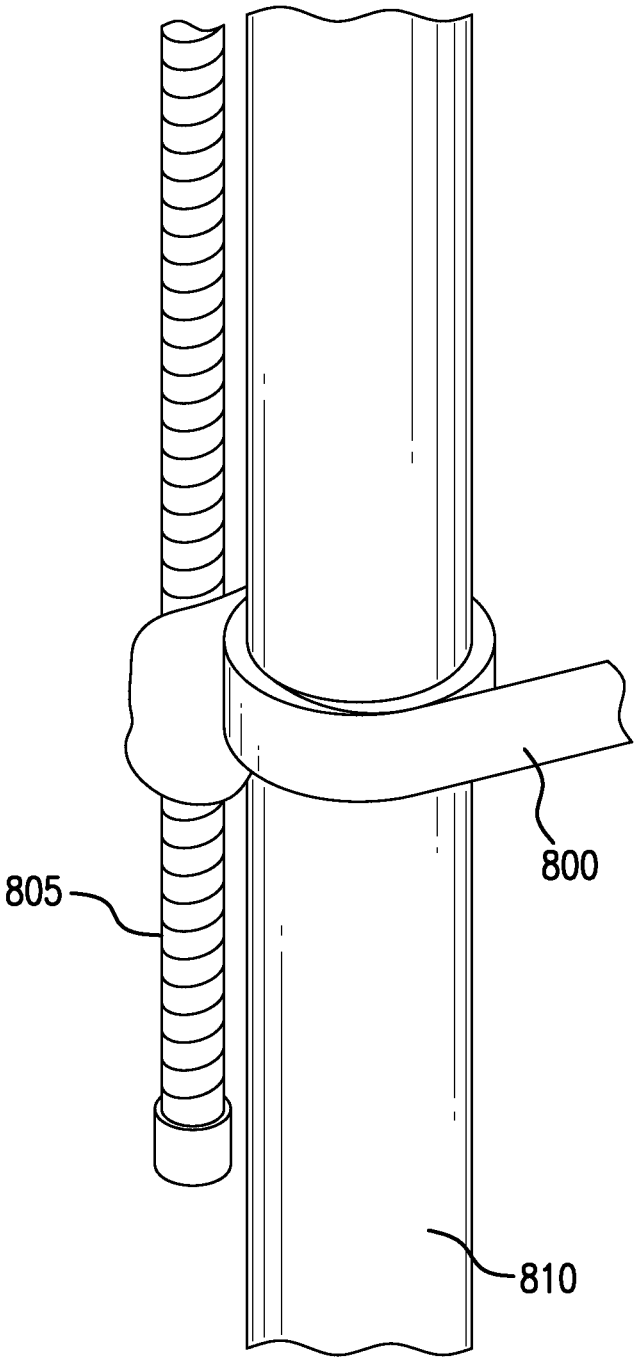
FIG. 8 depicts a perspective view of an exemplary tree topper with trunk attachable deformable conduit attached to an artificial tree trunk.
Figure 9:
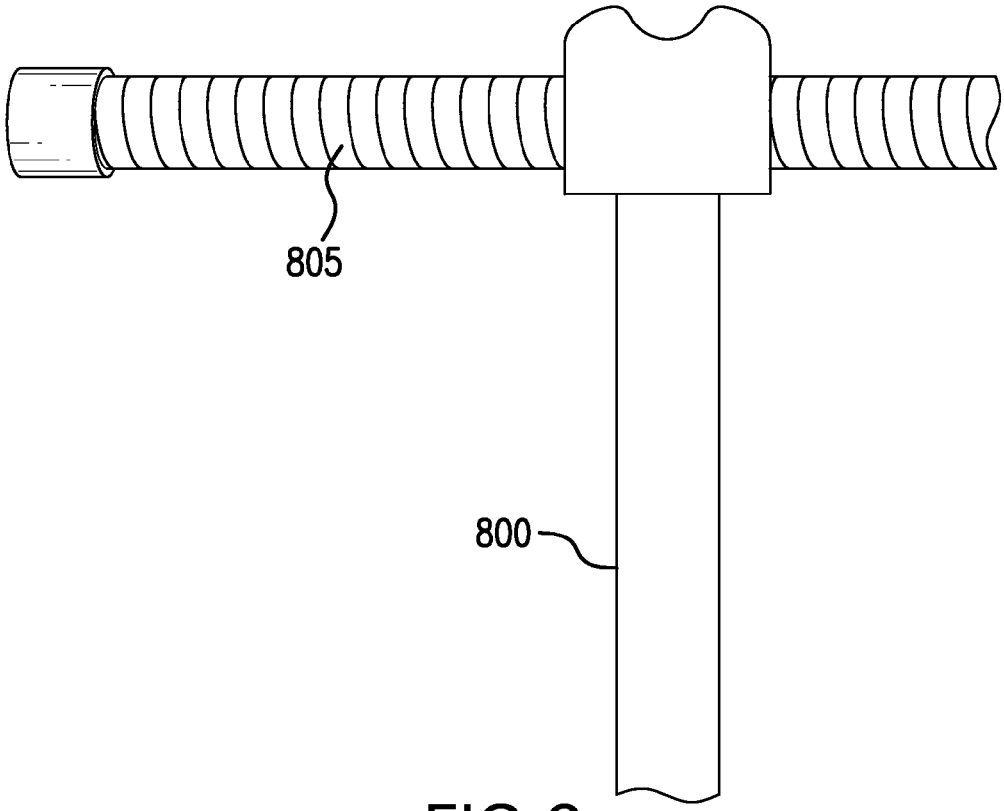
FIG. 9 depicts a close-up perspective view of an exemplary hook-and-loop clamp for a tree topper system.

FIGS. 8-9 depict perspective views of an exemplary tree topper with trunk attachable deformable conduit attached to an artificial tree trunk. In the FIGS. 8-9 depictions, an exemplary hook-and-loop style connector 800 is shown connected to a deformable conduit 805. The exemplary hook-and-loop style connector 800 may connect the deformable conduit 805 to a tree trunk 810.

Figure 11A:
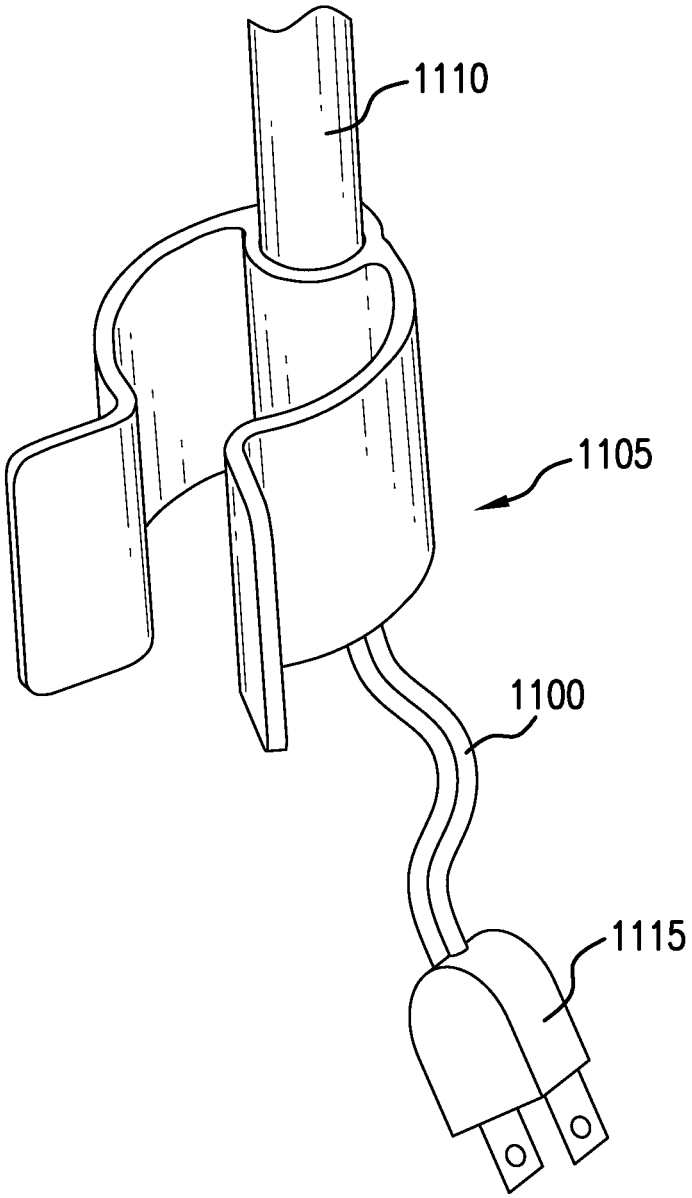
FIGS. 11A-C depict schematic views of various tree top electrical connectors.
Figure 11B:
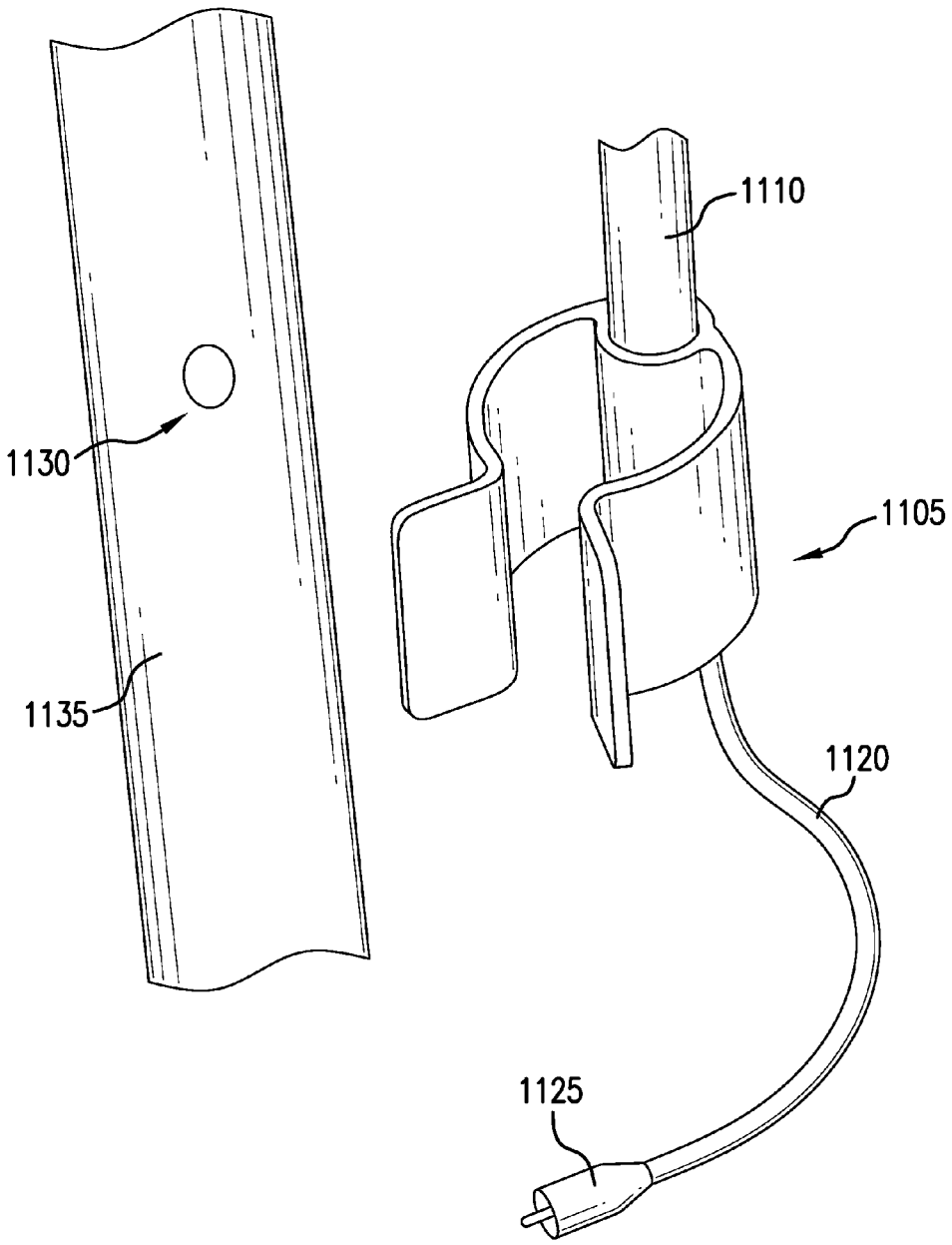
Figure 11C:
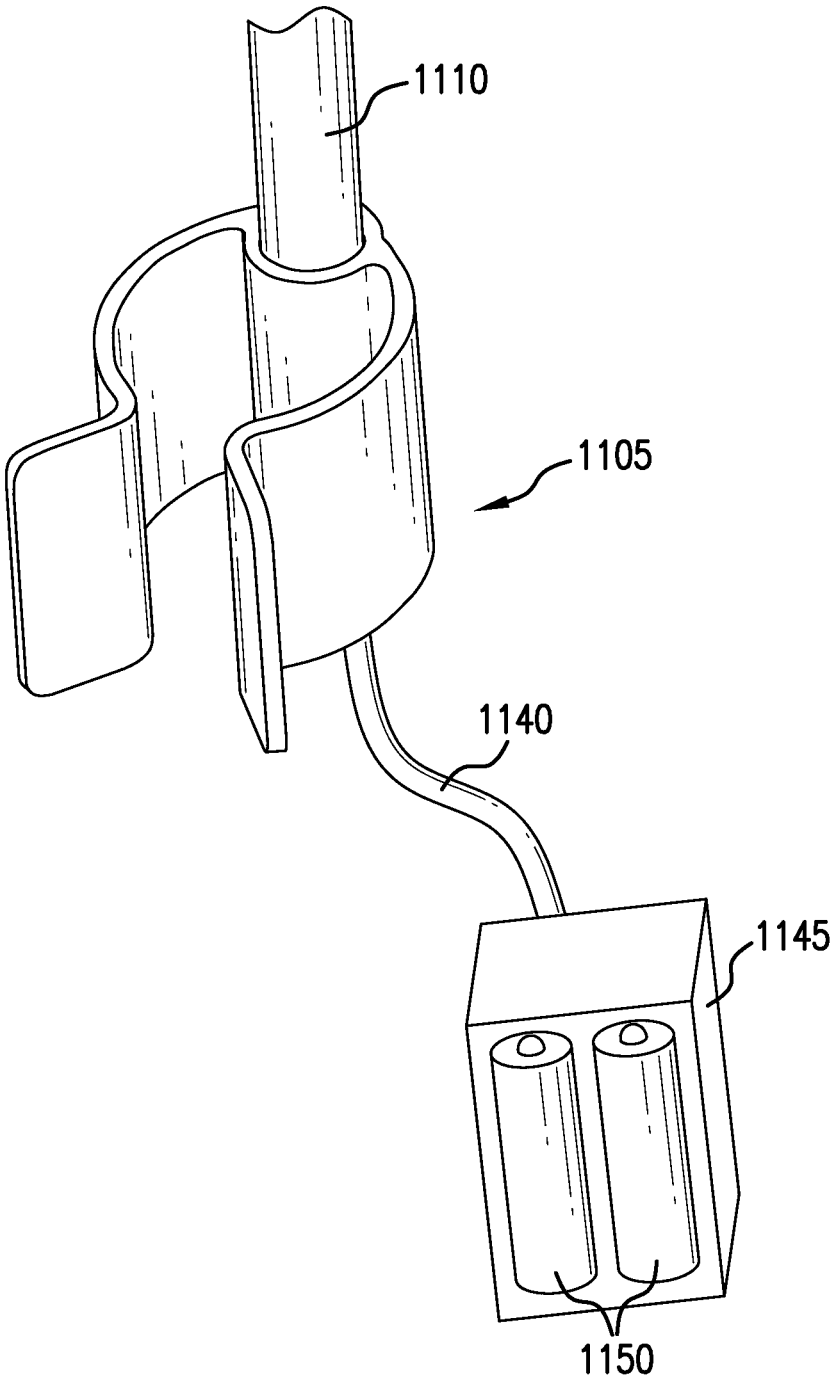

FIGS. 11A-C depict schematic views of various tree top electrical connectors. In FIG. 11A, an electrical cord 1100 is shown emerging from a bottom end 1105 of a conduit 1110. The electrical cord 1105 is attached to an electrical plug 1115. In the depicted embodiment, the electrical plug 1115 may be configured to connect to an AC power outlet. In FIG. 11B, an electrical cord 1120 is shown emerging from the bottom end 1105 of the conduit 1110. An electrical connector 1125 is attached to the electrical cord 1120. The electrical connector 1125 may be configured to attach to a complementary connection port 1130 on a tree trunk segment 1125. In some embodiments, the tree trunk segment 1130 may have one or more electrical channels within. The connection port 1130 may electrically couple to one or more of the electrical channels. In FIG. 11C, an electrical cord 1140 is shown emerging from a bottom end 1105 of the conduit 1110. The electrical cord 1140 is connected to a battery holder 1145. In the depicted embodiment, the battery holder 1145 contains two batteries 1150. In some embodiments, an electrical connector may be configured to plug into a light socket of a light string. For example, a light element may be removed from a light string leaving an unused light socket. The light socket may then be used by an electrical connector for a tree top ornament system.

Although various embodiments have been described with reference to the Figures, other embodiments are possible. For example, in some embodiments, the conduit may provide passage for a power channel therethrough. In an exemplary embodiment, power and/or signal channels may be coupled to the conduit. In an exemplary embodiment, a coupler that connects a tree topper to a tree trunk may include a channel connector. For example, when the tree topper is mechanically connected to the tree trunk, one or more electrical channels in the tree topper may be connected to one or more channels of the tree trunk.

In some embodiments, one or more lighting element may be coupled to the ornament sleeve. The lighting element may be configured to illuminate a clear or semi-clear ornament received into the ornament sleeve, for example. In an illustrative embodiment, a sleeve may have an electrical channel coupler that provides connection between a channel in an ornament and a channel in the tree topper when an ornament is received in the hollow.

Various embodiments provide for releaseable connection of an ornament and a tree topper device. For example, in some embodiments, a hollow may receive an ornament. In an exemplary embodiment the sleeve may instead be a projection, upon which an ornament is positioned. In some embodiments an ornament connector is vertically presented at a top vertical surface for connection to an ornament.

In some embodiments, wireless transmission of lighting control may be performed using a mobile device. For example, a cell phone may run a lighting control app. In some embodiments, a tablet computer may run a lighting control program. Transmission between a mobile device a lighting system may be wireless. Various transmission protocols may be used when transmitting lighting commands. For example, transmission may be performed using Bluetooth and/or ZigBee and/or Wi-Fi, or other protocols. In some embodiments, IR light transmission of lighting controls may be used, for example. In some embodiments, transmission may be directly between lighting elements and a mobile device. In some embodiments, transmission may be from a mobile device to a control module, for example. In some embodiments, a lighting display may be controlled from a wireless router. In some embodiments, a control module may use wireless cellphone protocols for transmission. Control signals may be sent to such a control module via a phone call (and/or a text message), for example.

In various embodiments, various methods of controlling lighting elements may be used. Some such methods have been described, for example, at [0043-0048] and in FIG. 8 of U.S. patent application Ser. No. 13/426,577, titled "Low Voltage Coupling Design," filed by hangmen Yi Xin Long on Mar. 21, 2012, the entire disclosure of which is hereby incorporated by reference.

In various embodiments, various tree ornaments may be coupled to a holiday tree. For example, illuminated ornaments may be coupled to a power and control network of a tree. In some embodiments, a tree ornament may be coupled to a coupling site on a tree limb or on a tree trunk segment. In some embodiments, an ornament may couple to a light string. For example, in some embodiments, a lighted tree ornament may have a connector configured as a light element of a light string. For example, the connector may replace a light element and draw power from the light element's connector on the light string. In some embodiments, the tree ornament may be battery powered. In some embodiments, the tree ornament may draw power from the tree's power distribution network. In some embodiments, the tree ornament may receive control signals via the tree's control signal distribution network. In an exemplary embodiment, a tree ornament may receive control signals wireless (e.g. Bluetooth, ZigBee, Wi-Fi, etc.).

In various embodiment, various methods of providing power and control to illuminated holographic tree ornament may be used. Some such holographic tree ornaments have been described, for example, at [0007-0008 and 0013] and in FIG. 1 of U.S. patent application Ser. No. 13/767,833, titled "Decorative Holographic Ornament," filed by Jason Loomis on Feb. 14, 2013, the entire disclosure of which is hereby incorporated by reference.

The illuminated tree top ornament apparatus of the present invention provides a tree top ornament with one or an array of LED or other lights, with an attachment mechanism for releasable attachment to the top branch or trunk of artificial and natural trees. The lights are connected to a sleeve designed to fit over the top vertical branch of the tree, but which is supported by a rigid conduit that clamps to the tree branch some distance below the top, so that the top of the branch does not itself bear any of the tree top ornament's weight. The user may selectively attach a variety of clear and semi clear acrylic or glass ornamental tree toppers for illumination by the lights.

One problem with many natural and artificial trees is that the top of the tree often does not have the capacity to bear weight, making it difficult to place a tree top ornament. With the inventive design the user is able to clamp the apparatus onto the tree trunk some distance below the top of the tree (e.g., eighteen inches) at a point where the trunk is bigger, stronger, and more rigid.

It is therefore an object of the present invention to provide a new and improved lighting apparatus.

It is another object of the present invention to provide a new and improved illuminated tree top ornament.

A further object or feature of the present invention is a new and improved tree top ornament that can be used with either natural or artificial trees.

An even further object of the present invention is to provide a novel tree top ornament that permits placement of the ornament even on small or weak trees.

Other novel features which are characteristic of the invention, as to organization and method of operation, together with further objects and advantages thereof will be better understood from the following description considered in connection with the accompanying drawing, in which preferred embodiments of the invention are illustrated by way of example. It is to be expressly understood, however, that the drawing is for illustration and description only and is not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

Figure 10:
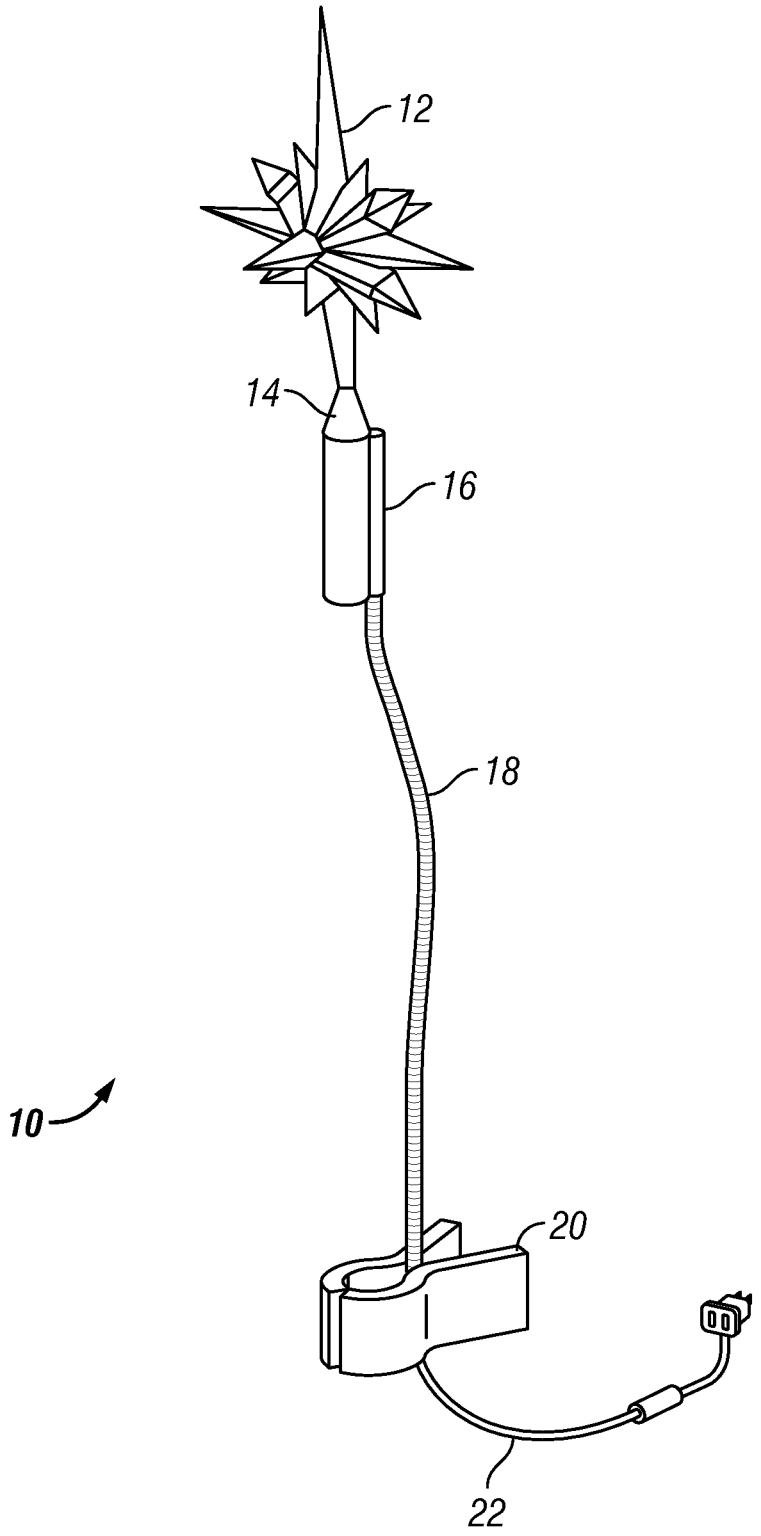
FIG. 10 is a front elevation view of an illuminated tree top ornament apparatus of this invention.

Referring to FIG. 10, there is illustrated therein a new and improved illuminated tree top ornament apparatus, generally denominated 10 herein. Apparatus 10 includes an ornament such as a star 12 attached to an LED or LED array 14, a sleeve 16 for placement on the end of a branch or tree trunk, a cable 18, a clamp 20, and electrical cord 22. The cable 18 is stiff (but may be deformable), and acts as a conduit for the cord 22 carrying the electricity to the LED light(s).

The adjustable cable/conduit 18 supports the sleeve 16, LED array 14 and ornament (e.g., star) 12. The sleeve 16 preferably includes a conical hollow **16*a* on the bottom which is designed to fit over the top vertical branch of the tree, but since it is supported by the rigid conduit 18** that clamps to the tree branch some distance below the top, the top of the branch does not itself bear any of the tree top ornament's weight.

The LED or other lights may be clear or of any color, or of variable color, to give the desired effect to the illuminated ornament. The sleeve, conduit, clamp, cord, and other visible components are preferably of a construction and color to blend with the tree.

A variation of the inventive apparatus provides a table top (or mantle, windowsill, or other surface) apparatus that illuminates the acrylic objects (e.g., star, angel). This table top LED array may be made in two versions and has two functions.

A first version is battery operated and may work on a 24 hour timer that turns on for 5 hours (or more or less) each day automatically. A second version utilizes a rechargeable battery that rests in home position on a charging plate, much like a wireless home phone, and can then be put on a dinner table or in a windowsill when desired. This version may also work on a 24 hour timer and turn on for a selected period each day automatically.

A first function of the inventive table top apparatus is the illumination of the acrylic pieces. A second function is that the apparatus can be used to illuminate a standard pillar candle (made of real wax). This allows the user to create a beautiful light effect in the candle material but they can use real candles that are actually lit.

Some aspects of embodiments may be implemented as a computer system. For example, various implementations may include digital and/or analog circuitry, computer hardware, firmware, software, or combinations thereof. Apparatus elements can be implemented in a computer program product tangibly embodied in an information carrier, e.g., in a machine-readable storage device, for execution by a programmable processor; and methods can be performed by a programmable processor executing a program of instructions to perform functions of various embodiments by operating on input data and generating an output. Some embodiments can be implemented advantageously in one or more computer programs that are executable on a programmable system including at least one programmable processor coupled to receive data and instructions from, and to transmit data and instructions to, a data storage system, at least one input device, and/or at least one output device. A computer program is a set of instructions that can be used, directly or indirectly, in a computer to perform a certain activity or bring about a certain result. A computer program can be written in any form of programming language, including compiled or interpreted languages, and it can be deployed in any form, including as a stand-alone program or as a module, component, subroutine, or other unit suitable for use in a computing environment.

Suitable processors for the execution of a program of instructions include, by way of example and not limitation, both general and special purpose microprocessors, which may include a single processor or one of multiple processors of any kind of computer. Generally, a processor will receive instructions and data from a read-only memory or a random access memory or both. The essential elements of a computer are a processor for executing instructions and one or more memories for storing instructions and data. Storage devices suitable for tangibly embodying computer program instructions and data include all forms of non-volatile memory, including, by way of example, semiconductor memory devices, such as EPROM, EEPROM, and flash memory devices; magnetic disks, such as internal hard disks and removable disks; magneto-optical disks; and, CD-ROM and DVD-ROM disks. The processor and the memory can be supplemented by, or incorporated in, ASICs (application-specific integrated circuits). In some embodiments, the processor and the member can be supplemented by, or incorporated in hardware programmable devices, such as FPGAs, for example.

In some implementations, each system may be programmed with the same or similar information and/or initialized with substantially identical information stored in volatile and/or non-volatile memory. For example, one data interface may be configured to perform auto configuration, auto download, and/or auto update functions when coupled to an appropriate host device, such as a desktop computer or a server.

In some implementations, one or more user-interface features may be custom configured to perform specific functions. An exemplary embodiment may be implemented in a computer system that includes a graphical user interface and/or an Internet browser. To provide for interaction with a user, some implementations may be implemented on a computer having a display device, such as an LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including packet-based messages on a communication network. Examples of communication networks include, e.g., a LAN (local area network), a WAN (wide area network), MAN (metropolitan area network), wireless and/or optical networks, and the computers and networks forming the Internet. Other implementations may transport messages by broadcasting to all or substantially all devices that are coupled together by a communication network, for example, by using omni-directional radio frequency (RF) signals. Still other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, or multiplexing techniques based on frequency, time, or code division. Some implementations may optionally incorporate features such as error checking and correction (ECC) for data integrity, or security measures, such as encryption (e.g., WEP) and password protection.

A number of implementations have been described. Nevertheless, it will be understood that various modification may be made. For example, advantageous results may be achieved if the steps of the disclosed techniques were performed in a different sequence, or if components of the disclosed systems were combined in a different manner, or if the components were supplemented with other components. Accordingly, other implementations are within the scope of the following claims.

What is claimed is:

1. An illuminated tree top ornament apparatus comprising:

an ornament configured to be illuminated by at least one light;

an ornament sleeve configured to attach to the ornament, the ornament sleeve configured to provide an electrical signal to the at least one light;

a conduit having an upper end connected to the ornament sleeve; and, a clamp connected to the conduit and configured to connect to a top vertical tree branch at a predetermined distance below a top of the top vertical tree branch so as to present the ornament, when attached to the ornament sleeve, above the top of the top vertical branch, wherein the conduit is configured such that, when the clamp is connected to the top vertical tree branch at the predetermined distance below the top of the top vertical branch, the top of the top vertical tree branch does not bear any of the weight of the ornament, the at least one light, and the ornament sleeve.

2. The illuminated tree top ornament apparatus of claim 1, wherein the conduit is a rigid conduit.

3. The illuminated tree top ornament apparatus of claim 1, wherein the conduit is a deformable conduit.

4. The illuminated tree top ornament apparatus of claim 1, wherein the ornament sleeve is configured to releaseably attach to an ornament.

5. The illuminated tree top ornament apparatus of claim 1, wherein the ornament sleeve is adapted to receive an ornament selected from a plurality of ornaments.

6. The illuminated tree top ornament apparatus of claim 1, further comprising an electrical wire connected to the ornament sleeve and running within the conduit.

7. The illuminated tree top ornament apparatus of claim 1, wherein the at least one light is coupled to the ornament sleeve.

8. The illuminated tree top ornament apparatus of claim 1, wherein the at least one light is coupled to the ornament.

9. The illuminated tree top ornament apparatus of claim 1, wherein the ornament is a clear or semi-clear ornament.

10. The illuminated tree top ornament apparatus of claim 1, further comprising a control module that receives control signals and generates lighting signals in response to the received control signals.

11. The illuminated tree top ornament apparatus of claim 1, wherein the ornament comprises:

a substantially transparent hollow body having an inside surface with holographic features applied to the inside surface, wherein when the at least on light is illuminated, holographic images are generated and visible from the outside of the ornament.

12. The illuminated tree top ornament apparatus of claim 11, wherein the control module wirelessly receives control signals.

13. The illuminated tree top ornament apparatus of claim 11, wherein the control module receives control signals via wires.

14. The illuminated tree top ornament apparatus of claim 1, wherein the clamp comprises a clip.

15. The illuminated tree top ornament apparatus of claim 1, wherein the clamp comprises a hook and loop material strap.

16. The illuminated tree top ornament apparatus of claim 1, wherein the clamp comprises a magnet.

17. The illuminated tree top ornament apparatus of claim 1, wherein the clamp comprises a deformable twist-tie.

18. The illuminated tree top ornament apparatus of claim 1, wherein the conduit is a deformable conduit.

19. An illuminated tree top ornament apparatus comprising:

an ornament configured to be illuminated by at least one light;

an ornament sleeve configured to attach to the ornament, the ornament sleeve configured to provide an electrical signal to the at least one light;

a conduit having an upper end connected to the ornament sleeve; and, a clamp configured to connect to the conduit and to a top vertical tree branch at a predetermined distance below a top of the top vertical tree branch so as to present the ornament, when attached to the ornament sleeve, above the top of the top vertical branch, wherein the conduit is configured such that, when the clamp is connected to both the conduit and the top vertical tree branch at the predetermined distance below the top of the top vertical branch, the top of the top vertical tree branch does not bear any of the weight of the ornament, the at least one light, and the ornament sleeve.

20. An illuminated tree top ornament apparatus comprising:

an ornament configured to be illuminated by at least one light;

an ornament sleeve configured to attach to the ornament, the ornament sleeve configured to provide an electrical signal to the at least one light;

a conduit having an upper end connected to the ornament sleeve; and, means for clamping the conduit to a top vertical tree branch at a predetermined distance below a top of the top vertical tree branch so as to present the ornament, when attached to the ornament sleeve, above the top of the top vertical branch, wherein when the conduit is clamped to the top vertical tree branch at the predetermined distance below the top of the top vertical tree branch, the top of the top vertical branch does not bear any of the weight of the ornament, the at least one light, and the ornament sleeve.

* * * * *